United States Patent [19]

Andersen

[11] Patent Number: 4,577,185

[45] Date of Patent: Mar. 18, 1986

[54] CONSTRUCTION FOR ALERTING HEALTH-CARE PROFESSIONALS

[75] Inventor: Frieda Andersen, Munster, Ind.

[73] Assignee: Saint Margaret Hospital, Hammond, Ind.

[21] Appl. No.: 518,531

[22] Filed: Jul. 29, 1983

[51] Int. Cl.[4] ..... G08B 23/00

[52] U.S. Cl. ..... 340/573

[58] Field of Search ..... 340/573, 575, 571; 339/182, 183; 24/572, 623

[56] References Cited

U.S. PATENT DOCUMENTS

| | | | |
|---|---|---|---|
| 2,220,158 | 11/1940 | Kohler | 339/182 R |
| 2,719,185 | 9/1955 | Sorg et al. | 339/182 T |
| 3,729,729 | 4/1973 | Geller et al. | 340/573 X |
| 3,851,326 | 11/1974 | Costa | 340/571 |
| 4,067,005 | 1/1978 | Levy et al. | 340/573 |
| 4,286,589 | 9/1981 | Thompson | 340/573 X |
| 4,300,130 | 11/1981 | Fotheringham et al. | 340/571 X |

*Primary Examiner*—James L. Rowland
*Assistant Examiner*—Brian R. Tumm
*Attorney, Agent, or Firm*—Allegretti, Newitt, Witcoff & McAndrews, Ltd.

[57] ABSTRACT

An improved health-care professional alert system is disclosed. The system is compatible with existing health-care professional call systems having a patient operable call unit; a cord connecting the unit to a receptacle; a detector determining when the patient call unit is disconnected from the receptacle; and an activator that operates an alarm signal upon detection of a patient-unit disconnect. The invention comprises an insert mateable with the existing receptacle, the insert being connected by a cord to a patient's body or gown. In the preferred embodiment, the cord is connected to a patient's body by a spring operated clip.

2 Claims, 7 Drawing Figures

Fig. 1
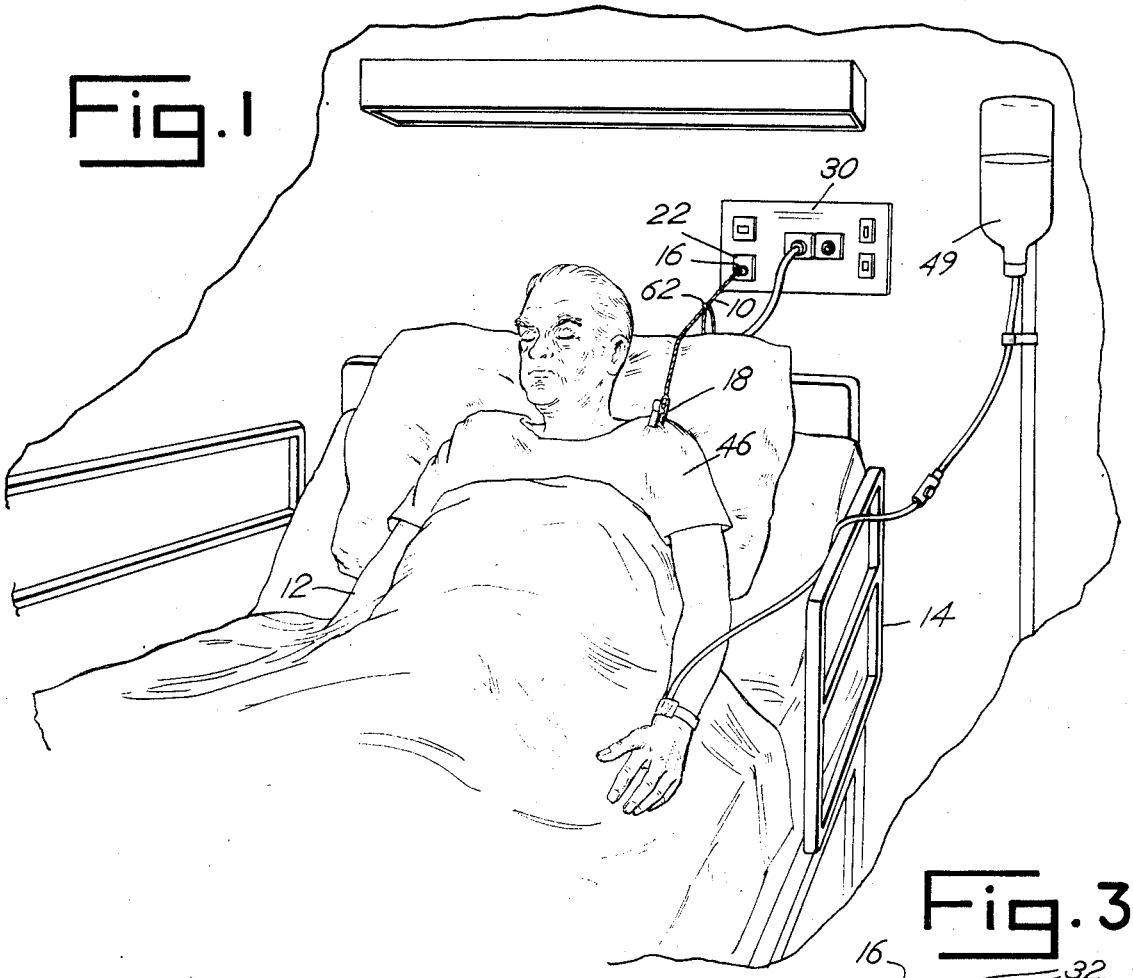
Fig. 3
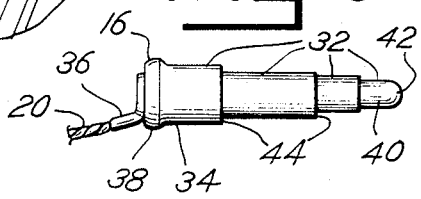
Fig. 2
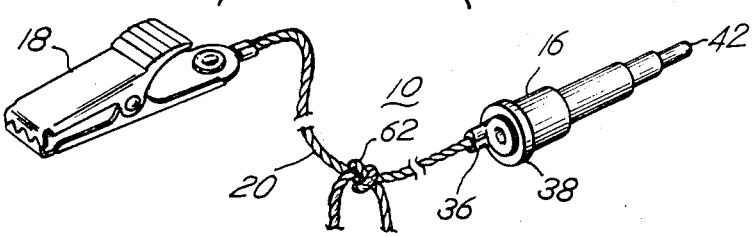
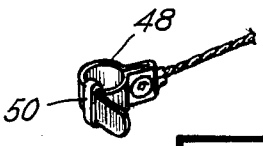
Fig. 4
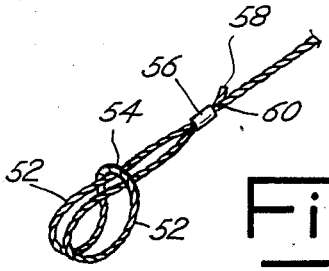
Fig. 5

CONSTRUCTION FOR ALERTING HEALTH-CARE PROFESSIONALS

BACKGROUND OF THE INVENTION

This invention relates to an improved construction for alerting health-care professionals, such as nurses, orderlies and the like, in the event of undesirable movement by a patient in a hospital or other health-care facility. More specifically, the invention relates to an improved construction for alerting health-care professionals that can be activated upon a patient's undesirable movement and without a conscious choice by the patient to so activate. Additionally, the invention relates to an improved construction and method for alerting health-care professionals that is compatible with existing call systems.

Hospitals, nursing homes, and other health-care facilities conventionally have communication systems designed to allow patients to call nurses, orderlies or other health-care professionals. Traditionally, such call systems include an electronic communication system having a patient-operable signal device located at each patient's bed or treatment location. Such patient-operable signalers often consist of a button or switch unit connected by a message transmitting cord to a wall receptacle. The wall receptacle is usually connected to an information switching system, so that operation by the patient of the button or switch unit activates a signal within the information switching system, which thereafter operates an alarm that may be perceived or observed by a health-care professional at a remote location. Such health-care professional call systems are constructed in a variety of different configurations, and are generally well known to persons skilled in the art.

Existing health-care professional call systems have a significant drawback: activation of the system requires a conscious decision by the patient to call the health-care professional, because the patient must push the button or throw the switch. Consequently, patients who are confused, have a nocturnal disorientation, require assistance in moving where there is evidence they will not ask for help, are under the influence of narcotics or sedatives, or are subject to temporary or permanent disorientation, are often unable to activate the call system. Moreover, conventional call systems cannot be activated by sleeping patients. In many instances, such patients undergo undesirable movement, as, for example, when attempting to sit upright or get out of bed, or when they are attached to some medical treatment apparatus, and thereby aggravate their condition. Further, disoriented patients, or patients unable to walk without the assistance of crutches or some other device, may often in the initial moments of waking believe themselves to be at home and in familiar surroundings. Such patients will occasionally attempt to get out of bed, or move in some other undesirable manner, while not realizing that they are suffering from a partially or wholly disabling injury. The patient's attempt at movement can result in new injuries or aggravation of old injuries if a health-care professional is not alerted immediately to assist the movement.

Conventionally, confused and disoriented patients of the kind described above have been protected by subjecting them to an increased frequency of surveillance by health-care professionals or by relying on the patient's ability to activate the existing call system after the disorientation has ceased. In some instances, health-care professionals are alerted by other patients in the vicinity. Alternatively, sophisticated devices have been attached to the patient to monitor various aspects of a patient's physiology and movement, such as heart rate, blood pressure, and other functions, so that when an undesirable variation in those function occurs, the devices automatically produce a signal or sound an alarm summoning a health-care professional. Such systems are normally expensive, cumbersome, and require elaborate supervision and maintenance. Sophisticated monitoring systems are therefore primarily used on patient's for whom such elaborate measures are required, such as patients undergoing intensive care.

It is therefore desirable that some relatively inexpensive and simple construction be developed for signaling health-care professionals upon any undesirable motion of a confused, disoriented, or sedated patient. Ideally, such a construction and method would operate through interaction with existing health-care professional call systems, so that extensive modification and installation of an elaborate new electronic communication systems will not be necessary. Moreover, it is desirable that such a system be constructed in a manner providing patients the option to activate the health-care professional alert system on their own conscious choice, without relying on undesirable movements.

Conventional health-care professional call systems are normally automatically activated when the button or switch unit is disconnected from the electronic signaling system. The connection between the cord and the wall receptacle normally consists of a plug at the end of the cord mateable with a receptacle mounted into a wall. The electronic signaling system includes a detector that determines when the plug has been removed from the receptacle, and upon such an occurrence activates the call signaler. Such systems are normally present in health-care professional alert systems that are "wired in" to the walls and physical structures of the health-care facility. Of course, "wired in" facilities are not necessary, and receptacles for call unit cords, and the entire system, may be attached to or rest on any structure, such as the patient's bed or surrounding furniture.

SUMMARY OF THE INVENTION

The present invention comprises an improved health-care professional alert system compatible with existing call systems having (a) a patient operable call unit, (b) a cord connecting that unit to a receptacle, (c) a detector which determines when the patient call unit is disconnect from the receptacle, and (d) an activator that operates an alarm signal upon detection of a patient unit disconnect. In the principal embodiment, the present invention includes an insert mateable with the existing receptacle, such insert connected by a cord to a means for attaching the cord to a patient's body or gown. In the preferred embodiment, the means for attaching the cord to a patient's body comprises a clip, such as an alligator clip or other spring-operated clip, which may be attached to the patient's gown. The length of cord attaching the clip to the insert may be adjusted by tying a loose knot in the cord, so that undesirable movement, such as a patient sitting up or attempting to get out of bed, pulls the insert from the receptacle. The disconnection resulting from removal of the insert from the receptacle is thereupon detected and results in activation of a health-care professional call signal. In the preferred embodiment, operation of the alert system simultaneously calls the health-care professionals and illuminates the lights in the patient's room to provide an opportunity for the patient to gain additional orientation.

Thus, it is an object of the present invention to provide a health-care professional call system having an improved means for alerting health-care professionals upon undesirable movement by a patient.

It is a further object of this invention to provide a health-care professional alert system that is operable upon undesirable movement of a patient without a conscious decision by the patient to activate the system.

A further object of this invention is a health-care professional alert system meeting the objects described above and simultaneously being compatible with existing health-care professional alert systems.

Still another object of the present invention is to provide a health-care professional alert system that is simple, easy to operate, and is independent of electrical power failures or constant maintenance of complex machinery.

Yet another object of this invention is to provide a health-care professional alert system meeting the objects described above and still capable of being operated by a conscience decision on the part of the patient.

These and other objects, advantages, and features of the invention will be set forth in greater detail in the description which follows.

BRIEF DESCRIPTION OF THE DRAWINGS

In the detailed description which follows, reference will be made to the drawings comprised of the following figures, wherein like numerals refer to like elements in the various drawings:

FIG. 1 is a perspective view of the health-care professional alert system in operation connected to a patient for whom some movements are undesirable;

FIG. 2 is perspective view of a principal embodiment of the invention, showing an insert, a clip, and a cord connecting the insert to the clip;

FIG. 3 is a side view of the preferred embodiment of the insert;

FIG. 4 is a perspective view of an alternative embodiments of the means for connecting the insert and cord to a patient for whom some movement is undesirable;

FIG. 5 is a perspective view of a second alternative embodiment of the means for connecting the insert and cord to a patient;

DESCRIPTION OF THE PREFERRED EMBODIMENT

Figure 6:
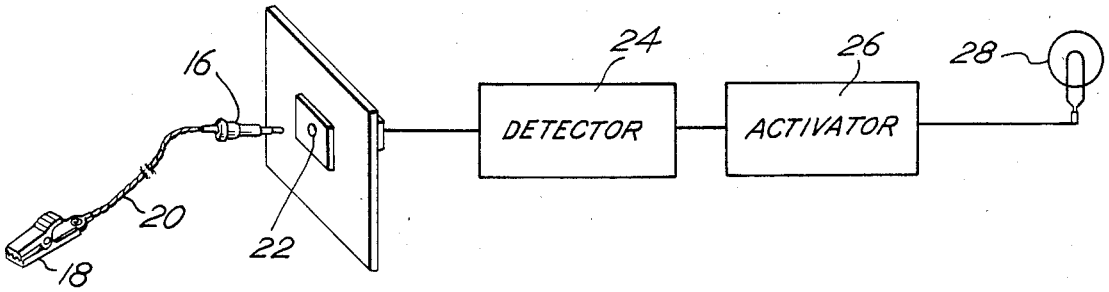
FIG. 6 is a combined perspective drawing and block diagram showing the basic elements of a full health-care professional alert system operable in accordance with the disclosure in this invention.

Referring now to FIGS. 1 and 2, a general illustration of the preferred embodiment is shown. As illustrated in FIG. 2, the invention generally comprises a construction 10. A patient 12, normally restricted to a bed 14, is shown with the construction 10 is operation. In the preferred embodiment, the construction 10 comprises an insert 16, a clip 18, and a cord 20 connecting the insert 16 and clip 18. As illustrated in FIG. 6, the insert 16 is inserted into a compatible receptacle 22. The receptacle 22 in the preferred embodiment is normally used for insert of the cord connecting a patient-operated call unit (not shown) in a conventional health-care professional call system. Also as shown in FIG. 6, the invention includes a detector 24, an activator 26, and a signal device 28 shown in FIG. 6 as a light bulb. The detector, activator, and signal device may all be permanently mounted in a wall 30 as shown in FIG. 1. Alternatively, the detector 24, activator 26, and signal device 28 may all be placed in a remote location in a manner well-known in the art or may be mounted along with the receptacle 22 on some other permanent structure in the patient's room, such as the bed 14.

FIG. 3 illustrates some of the details of the preferred embodiment of the invention. In preferred form, the insert 16 comprises a plurality of coaxial cylinders 32 with each cylinder of different diameter and stacked upon the other coaxial cylinders in order of progressively reducing diameter. The end 34 of the insert 16 having the largest diameter is connected to the cord 20 with a permanent fixture 36. The large end 34 has a larger diameter rim 38 for ease of removal of the insert 16 from the receptacle 22. The smaller diameter end 40 of the insert 16 is the portion first inserted into the receptacle 22. To ease that insertion, the smaller diameter end 40 has a rounded surface 42.

The connection between each of the coaxial cylinders 32 creates a plurality of right angle annular shelves 44, which upon insertion of the insert 16 into the receptacle 22 are mateable with the interior of the receptacle 22. The coaxial cylinders 32 consist of a variety of sizes so that insert 16 has a plurality of different shelves 44, and the insert 16 may be placed within a variety of different size and different shaped receptacle 22. Hence, a single insert 16 may be compatible with a variety of different conventional health-care professional call system receptacles.

Figure 7:
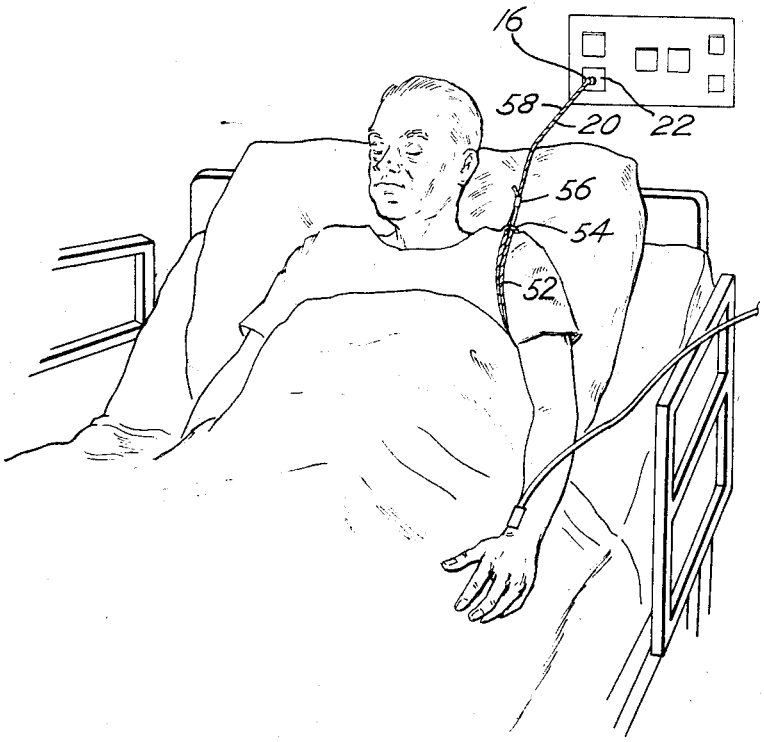
FIG. 7 is a perspective drawing of the alternative embodiment of the means for attaching the insert and cord shown in FIG. 5.

In the preferred embodiment, a spring-operated clip 18 is used for attaching the insert and cord to a patient. As shown in FIG. 1, the clip 18 is preferably attached to a portion of the patient's gown 46. The clip 18 may be constructed in a variety of different configurations and need not have the precise features shown in the illustrations. For example, the spring (not shown) used in clip 18 may be either a conventional wound spring, or may be a leaf spring utilizing a portion of the clip's frame. Referring to FIGS. 4 and 5, the means for attaching the insert 16 and cord 20 to the patient 12 need not be a clip. A clamp 48 as shown in FIG. 4 may also be used and connected to the patient around a wrist or other appendage. Such clamps may be adjustable in size, as shown by the buckle 50 in clamp 48. Alternatively, the clamp 48 may be attached to support instruments, such as an IV unit 49. Moreover, as illustrated in FIG. 5, the means for attaching the insert 16 and the cord 20 to the patient can consist merely of loops 52 of the cord 20 configured in a slip connection 54. Operation of the health-care professional alert system utilizing the embodiment shown in FIG. 5 is illustrated in FIG. 7. Generally, such a slip connection requires a permanent connection 56 of one end 58 of the cord 20 to an inner portion 60 of the same cord 20.

Alternatively, the cord 20 may be tied to some portion of the patient 12 or the patient's gown 46. The various embodiments illustrated in FIGS. 2, 4, and 5 for the means for connecting the insert 16 and the cord 20 to the patient 12 illustrate only some of the variety of ways in which the invention may be practiced.

In operation, the cord 20 is rarely of the exact length required for removal of the insert 16 from the receptacle 22 during undesirable motion of the patient 12. Accordingly, the cord 20 must be adjusted in length upon attachment of the cord 20 to the patient 12. Such an adjustment preferably consists of a knot 62 loosely tied in the cord 20 which allows temporary modification of the length of the cord 20 for each particular patient 12. Operation of the construction 10 and practice of the method of this invention begins with removal of the existing patient-operated call unit cord (not shown) from the receptacle 22. The clip 18 is then attached to the patient 12 or the patient's gown 46, and the knot 62 is tied into the cord 20 to adjust the cord's length.

Alternatively, the cord 20 may be attached to some other object or appendage of the patient 12 regarding which any undesirable movement should be detected.

Referring to FIGS. 1 and 6, movement by the patient 12, as for example results during an attempt to sit up or stand, stretchs cord 20 and pulls insert 16 from receptacle 22. The absence of either a plug or insert from receptacle 22 is detected by detector 24, which signals the activator 26. An alert device, such as lamp 28 is then operated by activator 26. Detector 24 and activator 26 may be comprised of a variety of different well-known constructions, either electrical, mechanical, or electromechanical.

In the preferred embodiment, detector 24 comprises a mechanical switch (not shown) within receptacle 22, such as is well-known in the art, which produces an electrical signal to activator 26 when the switch is operated by removing insert 16 from receptacle 22. Activator 26 preferably comprises any of the well-known electrical means for operating an electrical signaling device upon receipt of an electrical signal. In the preferred embodiment, the electrical signaling device is a lamp 28 within the room of the patient 12, as well as a signal light and tone received at a remote location by a health-care professional.

Operation of the health-care professional alert system may also be effected through a conscious decision by the patient, even though the button or switch call unit has been disconnected and replaced with the above-described construction. Should a patient desire to summon a nurse or other health-care professional, the patient 12 need merely grasp the cord 20, and pull the cord 20 with sufficient force to dislodge the insert 16 from the receptacle 22. As described above, removal of the insert 16 will result in activation of the alarm and lights 28.

While the preferred embodiments of the present invention have been set forth in the above-detailed description, the preferred embodiment is only an example of the invention. Other modifications may be used without departing from the scope of the present invention, and the invention is limited by the following claims and their equivalents.

What is claimed is:

1. An improved construction for operating a health-care professional alert system upon undesirable movement by a patient, the health-care professional alert system being of the kind having a signaling device that can be activated by a patient and capable of producing a signal detectable by health-care professionals, the signaling device having a patient-operable switch unit connected by a message transmitting cable to a wall-mounted receptacle and constructed such that removal of the patient-operable switch unit activates the signal, the construction comprising, in combination:

an insert mateable with the wall-mounted receptacle, the insert having an insertion end and an exposed end, the insert further comprising a plurality of stacked concentric cylinders, each cylinder being of progressively lesser diameter toward the insertion end, the insert being attached to the cord at the largest diameter cylinder, with the insertion of each cylinder to each adjoining cylinder defining an annular shelf mateable with portions of the interior of the receptacle, and the insert further being compatible with a plurality of receptacles that were each originally sized to receive different diameter inserts;

a segment of cord attached at one end of the exposed end of the insert; and means for attaching the remaining end of the cord segment to a patient comprising a spring operated clip attached to the cord segment opposite the insert;

whereby undesirable movement of the patient's body pulls on the cord and results in the detachment of the insert from the receptacle, so that the signaling device activates the signal and alerts a health-care professional that undesirable movement is occuring.

2. A construction as claimed in claim 1, wherein the signal comprises a visual signal detectable at a remote location and activation of an illumination source in the patient's room that allows the patient to see.

* * * * *